US005443029A

United States Patent [19]

Garnet

[11] Patent Number: 5,443,029

[45] Date of Patent: Aug. 22, 1995

[54] BOOKMARK HAVING BODY WITH LOOPED MARKING STRAPS AND SLIDABLY MOUNTED TABS

[76] Inventor: Arrow Garnet, 856 Upper James St., #20293, Hamilton, Ontario, Canada, L9C 7M8

[21] Appl. No.: 85,398

[22] Filed: Jun. 29, 1993

[51] Int. Cl.[6] ..... B42D 9/00

[52] U.S. Cl. ..... 116/235; 116/238

[58] Field of Search ..... 116/234, 238, 239, 235, 116/240; 281/42; D19/34

[56] References Cited

U.S. PATENT DOCUMENTS

| | | | |
|---|---|---|---|
| 139,936 | 6/1873 | Ward et al. | 116/235 |
| 1,322,796 | 11/1919 | Kissel | 116/238 |
| 1,894,533 | 1/1933 | Dempsey | 116/238 |
| 2,394,372 | 2/1946 | Evans | 116/238 |
| 2,405,374 | 8/1946 | Singer, Jr. | 281/42 |
| 2,576,783 | 11/1951 | Dewey | 116/238 X |
| 2,645,197 | 7/1953 | Jones et al. | 116/238 |
| 2,664,847 | 1/1954 | Orman | 116/239 |
| 2,716,390 | 8/1955 | Goins | 116/235 |
| 3,059,609 | 10/1962 | Sealana | 116/238 |
| 3,143,998 | 8/1964 | Madden | 116/238 |
| 4,861,073 | 8/1989 | Poretsky | 281/42 X |
| 4,982,685 | 1/1991 | Abe | 281/42 X |
| 5,022,342 | 6/1991 | Davis | 116/236 |

FOREIGN PATENT DOCUMENTS

| | | | |
|---|---|---|---|
| 2150077 | 6/1985 | United Kingdom | 116/234 |

*Primary Examiner*—William A. Cuchlinski, Jr.
*Assistant Examiner*—Willie Morris Worth
*Attorney, Agent, or Firm*—John R. Flanagan

[57] ABSTRACT

An improved bookmark includes a body having one surface substantially covered by an adhesive layer for mounting the body on a book. The adhesive layer is covered by a flexible peelable layer. The body also has a transparent pouch mounted thereon adapted to receive a label therein. The body further includes a slot defined near an edge thereof. The bookmark also includes a plurality of marking straps. Each marking strap has an end passing through the slot in the body and formed into a loop thereby securing the respective marking strap to the body. The bookmark further includes a plurality of tabs slidably mounted to the marking straps and movable therealong. The tabs can be set at predetermined positions along the straps for marking exact locations within a book.

13 Claims, 1 Drawing Sheet

BOOKMARK HAVING BODY WITH LOOPED MARKING STRAPS AND SLIDABLY MOUNTED TABS

BACKGROUND OF THE INVENTION

1. Field of the Invention

The present invention generally relates to a bookmark for marking book pages and, more particularly, is concerned with an improved bookmark having a body with looped marking straps and slidably mounted tabs.

2. Description of the Prior Art

Bookmarks have previously followed three general types. One type is a simple card or strip. A second type employs a removable clamping means in combination with chords or straps for marking pages. This second type of bookmark is taught in U.S. Pat. No. 2,645,197 to Jones and U.S. Pat. No. 3,143,998 to Madden. The clamping means in the Jones patent is accomplished by a bookmark body comprised of two slidable elements which clamp on the back of the book. The clamping means in the Madden patent features a bookmark body having a hook which inserts between the pages of the book. The third type comprises a semi-rigid strip which can be inserted in the back of a hard bound book and which has flexible chords or straps attached to the semi-rigid strip. An example of this type of prior art bookmark can be found in U.S. Pat. No. 2,394,372 to Evans.

The simple cards or strips can only mark one page at a time, can be easily separated from the book they are being used to mark and, accordingly, can be easily misplaced. The removable clamps in combination with marking strips are bulky and cumbersome. The semi-rigid strips having attached flexible chords can not be used on paperback books unless they are used in a fashion similar to simple cards or strips in which case they also can be easily misplaced.

Consequently, a need exists for a bookmark which avoids the disadvantages of prior art bookmarks.

SUMMARY OF THE INVENTION

The present invention provides an improved bookmark designed to satisfy the aforementioned need. Unlike prior art bookmarks, the improved bookmark of the present invention is not easily misplaced, bulky or cumbersome, and can be used with both paperback and hard bound books. This bookmark can be easily attached to a book. It has a plurality of marking straps and can be used to mark several pages. The term "book" is being used in a generic sense to cover any type of multiple page publication or the like.

Accordingly, the present invention is directed to an improved bookmark for marking book pages. The improved bookmark comprises: (a) a thin flat body having a pair of opposite surfaces and an elongated opening defined in the body; (b) fastening means on one of the opposite surfaces for fastening the body to the book; and (c) a plurality of marking straps extending from the body, each of the marking straps having a portion secured to the body by extending through the opening therein. More particularly, the opening in the body is a slot defined near an edge of the body. The secured portion of each marking strap is an end passing through the slot in the body and forming a loop thereby securing the respective marking strap to the body.

The improved bookmark also comprises: (a) a thin flat body having a pair of opposite surfaces; (b) fastening means on one of the opposite surfaces for fastening the body to the book; (c) a plurality of marking straps connected to and extending from the body; and (d) a plurality of tabs each being slidably mounted on and along one of the marking straps. Each of the slidable tabs includes a body having a longitudinal passage extending therethrough for receiving the marking strap therethrough. Also, the tab body has opposite upper and lower ends with the longitudinal passage extending through the body between and opening at the opposite upper and lower ends. The marking strap is inserted through the passage of the tab body so that the tab is slidably movable along the marking strap. Further, the lower end of the tab body has a tapered recess merging with the passage for receiving a folded back portion of the marking strap. The tab body is slidable into locking contact with the folded back portion of the marking strap thereby securing the tab at a predetermined position on the marking strap.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2, 3, 4, 5, 6, 7, 8, 9:
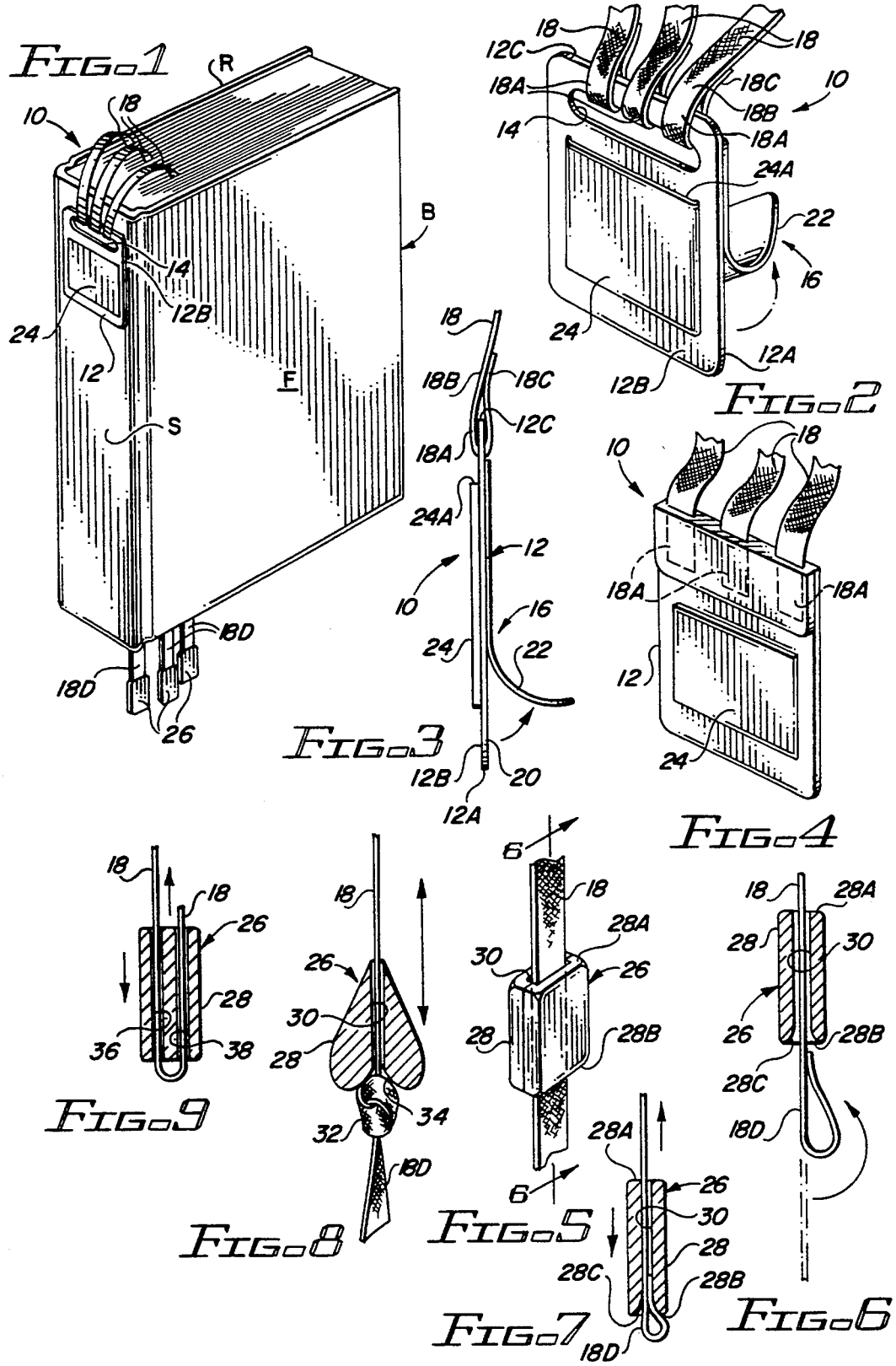
FIG. 1 is a perspective view of the bookmark of the present invention being shown attached to a book and being used to mark pages in that book.
FIG. 2 is an enlarged close-up view of the bookmark of FIG. 1 showing the flexible peelable layer and label pouch.
FIG. 3 is a side view of the bookmark of FIG. 1 further showing the flexible peelable layer.
FIG. 4 is a perspective view similar to that of FIG. 2 but showing an alternative embodiment of the bookmark.
FIG. 5 is a perspective view showing a tab slidably mounted on a marking strap.
FIG. 6 is a sectional view showing how a marking strap can be folded back to engage with the slidable tab.
FIG. 7 is a sectional view further showing how a marking strap can be folded back to firmly engage and lock a slidable tab.
FIG. 8 is a sectional view showing a tear-drop shaped slidable tab mounted on a marking strap which is held in position by knotting the marking strap just below the desired location of the slidable tab.
FIG. 9 is a sectional view showing how the marking strap extending through a first passage of the tab can be folded back through a second passage in the tab in order to shorten the length of the strap.

Referring to the drawings and particularly to FIG. 1, there is illustrated an improved bookmark, generally designated 10, of the present invention. The bookmark 10 is shown attached on the back or spine S of a book B. It should be apparent that the bookmark 10 is adapted to be attached on the front cover F or rear cover R of the book B, as an alternative to attachment on the spine S.

Referring to FIGS. 1–3, the bookmark 10 basically includes a substantially thin flat body 12 having a pair of opposite surfaces 12A, 12B and an opening in the form of an elongated slot 14 defined therein, fastening means 16 applied on one 12A of the opposite surfaces 12A, 12B for fastening the body 12 to the book B, and a plurality of elongated flexible marking straps 18 extending from the body 12, each of the marking straps 18 having a portion 18A secured to the body 12 through the slot 14.

More particularly, the elongated slot 14 in the body 12 of the bookmark 10 is defined near an edge 12C of the body 12. The secured portion 18A of each marking strap 18 is an end portion 18C passing through the slot 14 in the body 14 and then secured to an adjacent part 18B of the marking strap 18 so as to form a loop 18A thereby securing the respective marking strap 18 to the body 12. FIGS. 2 and 3 show an example of the manner in which the marking straps 18 can looped through slot 14 and around the edge 12C of the body 12. The end portions 18C of the marking straps 18 can either be sewn or bonded to the adjacent part 18B of the straps 18 to form the loops 18A. FIG. 4 shows an alternative embodiment wherein the slot 14 is omitted and instead the portions 18A of the straps 18 are secured between the edge 12C and an adjacent portion of the body 12 upon which the edge 12C is folded and attached.

Referring again to FIGS. 2 and 3, the fastening means 16 includes an adhesive layer 20 applied on the one surface 12A of the body 12 and a peelable flexible sheet 22 releasably applied over and covering the adhesive layer 20. Further, the bookmark 10 includes a label holding means 24 in the form of a pouch 24 disposed on the other 12B of the opposite surfaces 12A, 12B of the body 12 and thus opposite to the adhesive layer 20. The transparent pouch 24 is open along one edge 24A and spaced from the surface 12B of the body 12, adapting it to receive a label therebetween.

Referring to FIGS. 1 and 5–9, the bookmark 10 also includes a plurality of tabs 26 being slidably mounted on and along the respective marking straps 18. Each slidable tab 26 includes a body 28 having a longitudinal passage 30 in the form of a narrow slit 30 extending therethrough for receiving the respective marking strap 18 therethrough. Also, the tab body 28 has opposite upper and lower ends 28A, 28B with the longitudinal passage 30 extending through the body 28 between and opening at the opposite upper and lower ends 28A, 28B. As seen in FIG. 5, the respective marking strap 18 is inserted through the slit or passage 30 of the tab body 28 so that the tab is slidably movable along the marking strap 18. The tab body 28 can be fabricated in two halves which are sandwiched, snapped or otherwise connected together so as to encapsulate the strap 18 therebetween. The fit between the interior walls of the tab body 28 and the strap 18 are preferably sufficiently tight such that the tab 26 will remain at and not slip from any location to which it is moved relative to the strap 18. Thus the tab 26 can be set at a predetermined position along the strap 18 for marking an exact location on page within the book B which is marked by the strap 18. When not being used to mark a location on a page, the tab 26 can be positioned at the lower end portion 18D of the strap 18 outside of the book B.

Further, as seen in FIGS. 6 and 7, the lower end 8B of the tab body 28 has a tapered recess 28C merging with the passage 30 for receiving a folded back end portion 18D of the marking strap 18. The tab body 28 is slidable into locking contact with a lower end portion 18D of the marking strap 18, once it has been folded back, thereby adjustably locking or securing the tab 26 at a predetermined position on the marking strap 18. FIG. 6 shows the end portion 18D of the marking strap 18 in the process of being folded back and prior to insertion into the passage 30. FIG. 7 shows the folded back end portion 18D of the marking strap 18 after insertion into the adjustably locked position through the tapered recess 28C in the lower end 28B of the tab body 28 and into the passage 30 of the tab body 28.

The tab body 28 of FIGS. 1 and 5–7 has a generally rectangular shaped. An alternative configuration for the tab body 28 is the tear-drop configuration shown in FIG. 8. Also, as an alternative, the tab 26 in FIG. 8 is held in place upon strap 18 by tying a knot 32 at the desired location. The knot 32 can at least partially extend into a recess 34 formed in the lower end of the tab body 28. FIG. 9 shows another embodiment, being an alternative to that of FIGS. 6 and 7, in which a pair of spaced passages 36, 38 are defined through the tab body 28 through which portions of the strap 18 can be inserted as illustrated in order to shorten the length of the strap 18.

It should be understood that the bookmark 10 of the present invention can be made from any suitable material. Some examples of suitable materials are plastic and cloth, although other materials can be used also.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A bookmark for marking pages in a book, comprising:

(a) a substantially thin flat body having a pair of first and second opposite surfaces and an elongated slot defined in said body near an edge of said body;

(b) fastening means on said first of said opposite surfaces for fastening said body to the book;

(c) a plurality of marking straps extending from said body, each marking strap having a portion secured to said body, said secured portion of each said marking strap being an end portion of said strap passing through said slot in said body about said edge thereof and then secured to an adjacent part of said marking strap so as to define said secured portion as a loop securing said marking strap to said body through said slot; and (d) label holding means disposed on said second of said opposite surfaces of said body opposite said fastening means and adjacent to said slot.

2. A bookmark of claim 1 wherein said fastening means includes:

an adhesive layer applied to said first of said opposite surfaces of said body; and a peelable flexible layer covering said adhesive layer.

3. A bookmark of claim 1 wherein said label holding means includes a transparent pouch adapted to receive a label therein.

4. A bookmark for marking pages in a book, comprising:

(a) a substantially thin flat body having a pair of first and second opposite surfaces;

(b) fastening means on said first of said opposite surfaces of said body for fastening said body to the book, said fastening means including an adhesive layer applied to said first of said opposite surfaces of said body and a peelable flexible layer covering said adhesive layer;

(c) a plurality of marking straps connected to and extending from said body;

(d) a plurality of slidable tabs, each tab being slidably mounted on and along a different one of said plurality of marking straps in a sufficiently tight fitting relationship therewith such that each said tab can be set at a predetermined position along a respective marking strap for marking a location on a page within the book being marked by said respective marking strap; and (e) label holding means disposed on said second of said opposite surfaces of said body opposite said adhesive layer.

5. The bookmark of claim 4 wherein each of said slidable tabs has a tear-drop shaped body.

6. The bookmark of claim 4 wherein each of said slidable tabs has a rectangular shaped body.

7. The bookmark of claim 4 wherein each of said slidable tabs includes a body having a longitudinal passage extending therethrough for receiving said respective marking strap therethrough.

8. The bookmark of claim 7 wherein said tab body has opposite upper and lower ends with said longitudinal passage extending through said body between openings at said opposite upper and lower ends, said respective marking strap being inserted through said passage of said tab body so that said tab is slidably movable along said respective marking strap.

9. The bookmark of claim 8 wherein said lower end of said tab body has a tapered recess merging with said passage for receiving a folded back portion of said respective marking strap, said tab being slidable into locking contact with said folded back portion of said respective marking strap thereby securing said tab at a predetermined position on said respective marking strap.

10. A bookmark for marking pages in a book, comprising:

(a) a substantially thin flat body having a pair of first and second opposite surfaces and an elongated slot defined in said body near an edge of said body;

(b) fastening means on said first of said opposite surfaces of said body for fastening said body to the book;

(c) a plurality of marking straps connected to and extending from said body, each marking strap having an end passing through said slot in said body about said edge thereof and then secured to an adjacent part of itself so as to define said secured portion as a loop securing said marking strap to said body;

(d) a plurality of slidable tabs, each tab being slidably mounted on and along a different one of said plurality of marking straps in a sufficiently tight fitting relationship therewith such that each said tab can be set at a predetermined position along a respective marking strap for marking a location on a page within the book being marked by said respective marking strap; and (e) label holding means disposed on said second of said opposite surfaces of said body opposite said adhesive layer and adjacent to said slot.

11. The bookmark of claim 10 wherein each of said slidable tabs includes a body having a longitudinal passage extending therethrough for receiving said respective marking strap therethrough.

12. The bookmark of claim 11 wherein said tab body has opposite upper and lower ends with said longitudinal passage extending through said body between openings at said opposite upper and lower ends, said respective marking strap being inserted through said passage of said tab body so that said tab is slidably movable along said respective marking strap.

13. The bookmark of claim 12 wherein said lower end of said tab body has a tapered recess merging with said passage for receiving a folded back portion of said respective marking strap, said tab being slidable into locking contact with said folded back portion of said respective marking strap thereby securing said tab at a predetermined position on said respective marking strap.

* * * * *